United States Patent [19]

Scherrer et al.

[11] 4,130,988

[45] Dec. 26, 1978

[54] ELECTRONIC CIRCUIT FOR ELECTRONIC WATCH

[75] Inventors: Igor Scherrer, Colombier; Jean-Claude Berney, Lausanne; Jean-Claude Robert-Grandpierre, Colombier, all of Switzerland

[73] Assignee: Ebauches S.A., Neuchatel, Switzerland

[21] Appl. No.: 797,681

[22] Filed: May 17, 1977

[30] Foreign Application Priority Data

May 25, 1976 [CH] Switzerland ..... 6559/76
Mar. 22, 1977 [CH] Switzerland ..... 3561/77

[51] Int. Cl.[2] ..... G04C 17/00

[52] U.S. Cl. ..... 58/85.5; 58/23 R; 307/279

[58] Field of Search ..... 58/85.5, 23 R, 23 A, 58/23 AC; 307/279

[56] References Cited

U.S. PATENT DOCUMENTS

| | | | |
|---|---|---|---|
| 3,871,168 | 3/1975 | Maire | 58/23 R |
| 4,030,284 | 6/1977 | Portmann | 58/85.5 |
| 4,043,114 | 8/1977 | Takase | 58/85.5 |

*Primary Examiner*—Robert K. Schaefer
*Assistant Examiner*—William L. Feeney
*Attorney, Agent, or Firm*—Imirie, Smiley & Guay

[57] ABSTRACT

An electronic watch having a circuit for permitting it to be stopped in a state of minimum consumption. The watch has an oscillator, a frequency divider comprising flip-flops and a display, with the display and at least some of said flip-flops being connected to a common line so that a signal applied to the common line places them in a state of minimum consumption. The circuit including a switch connected between the common line and a terminal of the power supply and at least two MOS transistors connected so as to apply the signal to the common line when the switch is closed.

6 Claims, 7 Drawing Figures

ELECTRONIC CIRCUIT FOR ELECTRONIC WATCH

The present invention concerns an electronic watch having a circuit permitting stopping of the watch in a state of minimum consumption, the said watch comprising an electric power supply source, a quartz oscillator and a frequency divider composed of flip-flops, and a display means for time information, at least some of the said flip-flops and/or the said display means being arranged in a manner to be put in a state determined by a signal applied to a common line to which they are connected.

An electronic watch must be able to be stopped to permit its time setting or its stocking. In this last case, in general one leaves the oscillator functioning, for reasons of ageing, but it is necessary to reduce the consumption of the rest of the circuit to a value as low as possible, so as not to use the battery needlessly.

This result can be obtained, for example, by simply connecting a switch in series between the power source and the circuit which is to be stopped, but this requires a contact of very good quality, so that it will not disturb the functioning of the watch when it is closed, and that it does not allow a leakage current which is too large whilst it is open. On the other hand, when the switch is closed for restarting the watch, the state of flip-flops of the frequency divider is not determined if a return to zero circuit is not provided; it follows that the time between the closing of the contact and the appearance of the first impulse at the output of the divider is problematical.

One can likewise lock in a predetermined state, or resting state, all or part of the circuits of the watch, in particular the flip-flops of the division chain and the display means, in applying a determined signal on one of their inputs provided for this purpose, whilst these inputs are connected to a common line.

The application of this signal on this common line can likewise be effected in several ways:

One can use a switch to apply the required voltage on the common line, and a resistance to maintain another voltage when the switch is open; but this resistance must be very high, to limit the consumption when the switch is closed, and sufficiently low to fix with certainty the voltage of the common line when the switch is open, even if this latter presents a leakage resistance due, for example, to humidity. This resistance is moreover difficult to integrate if its value is high.

One can likewise use a switch contact associated with a circuit formed by two inverters (FIG. 1). This solution is interesting from the electric point of view, but mechanically more complex and delicate to make than those which call for a simple contact.

On the other hand, there are already known circuits for stopping the supply of a watch during the stocking or the time setting thereof, as for example, shown in U.S. Pat. No. 3,830,052. This circuit however does not permit the maintenance of the flip-flops of the frequency divider in a determined state, and neither does it leave the quartz oscillator functioning, as its function requires that it annuls the output signals of the quartz oscillator together with those of the frequency divider.

The object of the invention is to make a circuit suitable to deliver the required voltage to the common line with good reliability, a simple mechanical execution and a consumption of current which is practically nil in the stocking position.

In accordance with the present invention there is provided an electronic watch having a circuit for permitting stopping of said watch in a state of minimum consumption, the said watch comprising a power supply means, a quartz oscillator, a frequency divider comprised of flip-flops, and display means for displaying time information, at least some of the said flip-flops and/or the said display means being connected to a common line and arranged in such a way that a signal applied to said common line places them in a predetermined state, a switch, one of the terminals of which is connected to a first terminal of the supply and the other terminal to the common line, and, first and second MOS transistors having their sources connected to the second supply terminal and their drains to the common line, the gate of the first of these transistors being connected to means for enabling it to be conducting at least periodically, and the gate of the second of these transistors being connected to the common line via an inverter.

The present invention will be described further, by way of example, with reference to the accompanying drawings, in which.

Figure 1:
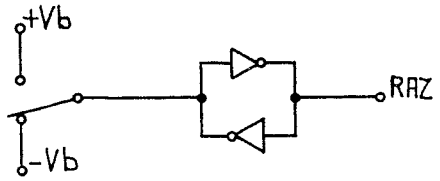
FIG. 1 shows a known embodiment to which there has already been made reference.
Figure 2:
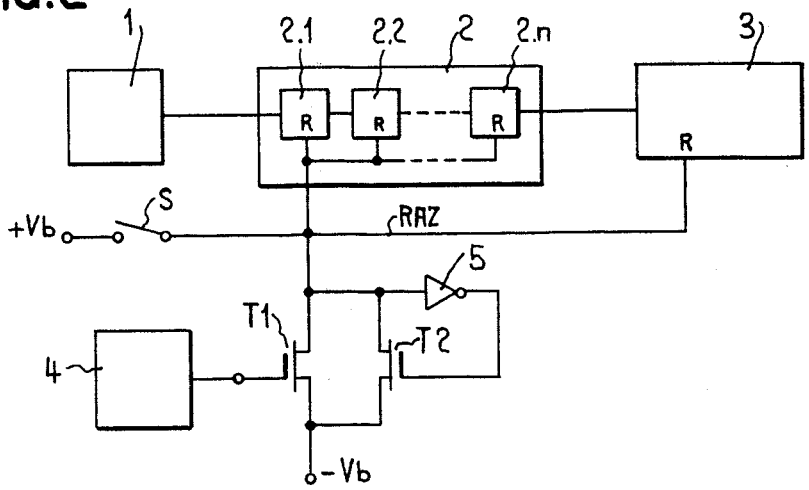
FIG. 2 shows a general block diagram of a watch using the circuit in accordance with the invention.

The watch shown schematically in FIG. 2 comprises an electric supply means (not shown) delivering the voltages $+V_b$ and $-V_b$, an oscillator 1 delivering impulses to a frequency divider 2 composed of flip-flops 2.1., 2.2, . . . 2.n. A display circuit 3 of liquid crystals for example, comprising the decoders and the necessary control circuits, displays the time information as a function of the signals which it receives from the divider 2.

The flip-flops 2.1. to 2.n are each provided with a blocking input R used to put them in a minimum consumption state, as well as the display circuit 3.

These inputs are connected together and to a circuit for stopping the watch in the minimum consumption state by a common line RAZ. When this line RAZ is at the voltage $-V_b$, the flip-flops of the divider 2, and the display circuit 3 function normally; when it is at the voltage $+V_b$, they are held in their minimum consumption state.

It is to be noted that, in certain cases, only some of the flip-flops composing the divider 2 are connected to the common line RAZ. Also, in watches having an LED display, which only consumes current when the control push button is operated, or even in watches having a display by a pointer or hands moved by a motor which only uses current when the divider provides it with impulses, it is not necessary to connect the display circuit to this common line RAZ.

The circuit for applying the required voltage on the line RAZ is constituted by a uni-polar switch S, operated, for example, by the hour resetting shaft, and connected between the positive pole $+V_b$ of the supply and the common line RAZ. Two n type MOS transistors T1 and T2 are provided with their drain terminals connected to the line RAZ and their sources terminals connected to the negative pole $-V_b$ of the supply.

The control electrode of the transistor T1 is connected, in this embodiment, to a self contained generator 4 which will be described in detail hereunder.

The control electrode of the transistor T2 is connected to the line RAZ via an inverter 5, the output of which always presents the opposite polarity voltage to that which is applied at its input.

Normally, when the watch is functioning, the switch S is open and the line RAZ is maintained at the voltage $-V_b$ by the transistor T2 which is conducting, since its control electrode is at the voltage $+V_b$. The transistor T1 is blocked for the majority of the time, but short positive impulses are applied, at intervals which are sufficiently far apart, to its control electrode by the generator 4, and make it momentarily conducting, without current flowing between its source and its drain, because these two electrodes are at the same voltage $-V_b$.

To stop the watch, the switch S is closed. A current is thus established through switch S and the transistor T2, but the voltage drop created by the internal resistance of this transistor causes the potential of the line RAZ to go a positive level such that the output of the inverter 5 goes to $-V_b$, which blocks the transistor T2. The voltage of the line RAZ is thus maintained at $+V_b$, which blocks the flip-flops of the divider 2 and the display 3 in their minimum consumption state. The current consumed in this state is thus limited to the current required by the oscillator 1, the generator 4 and the transistor T1 when it is made conducting by the impulses which it receives from the generator 4. The current through transistor T1 is limited by the internal resistance of T1, which can be increased by careful selection of its dimensions. Further, selection of a very low cyclic ratio for the impulses makes the mean current crossing the transistor T1 negligible. (The cyclic ratio is the ratio between the duration of the impulses and their periods).

To re-start the watch, the switch S is opened. The voltage of the line RAZ is indeterminate to start with, because T1 and T2 are blocked. But the first impulse delivered by the generator 4 after the opening of S makes T1 conducting. The voltage of the line RAZ thus becomes negative, which renders the transistor T2 conducting via the inverter 5, and the potential of the line RAZ thus passes to $-V_b$ with good reliability due to the low internal resistance of the transistor T2, even in the presence of strays or a leakage resistance in parallel with the switch S.

Figure 3:
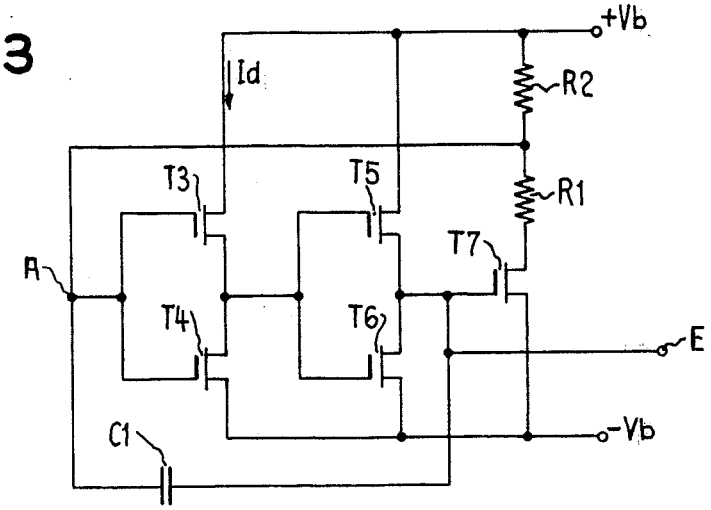
FIG. 3 shows a diagram of a known self-contained generator usable in the invention.

The generator 4 can be made in different manners. FIG. 3 shows a diagram of a known self-contained generator consuming very little current. It comprises a n type MOS transistor the drain of which is connected to the positive pole of the supply by two series resistances R1 and R2. The resistance R1 may in fact be the internal resistance of T7. It also includes a first inverter formed by a p type MOS transistor T3, and an n type MOS transistor T4, the input of the inverter being connected to the junction of the resistances R1 and R2. The output of the first inverter is applied to the input of a second inverter, formed by the MOS transistors T5 and T6, T5 being p type and T6 being n type. The output of the second inverter is connected to the gate of the transistor T7. A feedback capacitor C1 is connected between the output of the second inverter and the input of the first inverter. The output E of the generator is provided by the output of the second inverter, which is adapted to be connected to the control electrode of the transistor T1.

The functioning of such a generator is known, and thus will not be described further, other than to recall that the cyclic ratio of the impulses which it delivers is given by the ratio of the resistances R1 and R2, and their period by the product R2. C1.

These two values are not, on the other hand, critical in this application, but one would choose a period in the region of one millisecond and a cyclic ratio of around 5%.

The generator such as is shown has however a disadvantage in that the variation of the voltage at the point A is low and slow. It follows that the inverter formed by the transistors T3 and T4 switches relatively slowly, and that these transistors conduct simultaneously during a fairly long time, which increases the consumption in an inadmissible manner.

Figure 4:
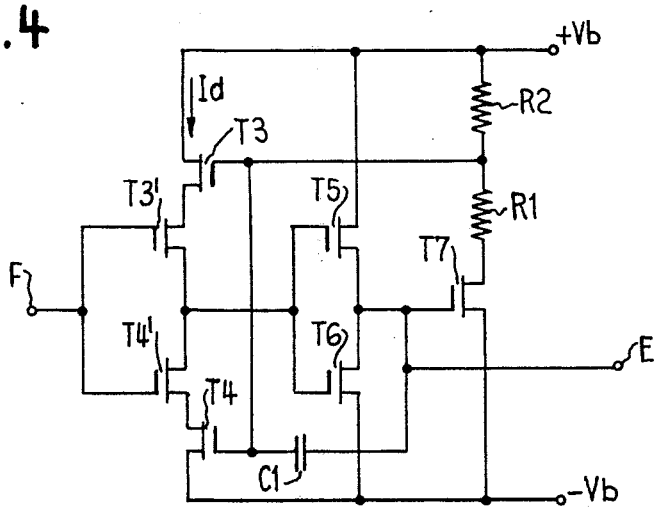
FIG. 4 shows a diagram of an improved self-contained generator.

To remedy this defect, one can introduce, as can be seen in FIG. 4, a supplementary switch formed of MOS transistors T3' and T4', T3' being p type, and T4' n type. This switch is supplied at its input F with a short leading edge signal, issuing, for example, from a quartz crystal oscillator. The current Id flowing through transistors T3 and T4 is then perfectly blocked, since the time during which T3' and T4' are simultaneously conducting is very short. The period of the impulses provided by the generator is lengthened by this addition, but this has no significance.

The circuit the diagram of which is shown in FIG. 5 again permits reduction of the consumption of the watch in the stocking position (switch S closed). It comprises the generator of FIG. 4 to which there has been added MOS transistors T8, T9 and T10, and a resistor R3. T8 and T10 are of p type and T9 of n type.

The transistor T8 and the transistor T3 have their sources and their drains connected together as have the transistors T9 and T4.

The transistor T10 has its source connected to the terminal $+V_b$, whilst its drain is connected via the resistor R3 to the terminal $-V_b$ of the supply. The transistors T8 and T10 are controlled by the signal on common line RAZ whilst the gate of the transistor T9 is controlled by the voltage appearing on the drain of the transistor T10. As in the preceding example, the input F of the generator 4 is connected to the output of the oscillator 1. the counting input 2c of the divider 2 is not now connected to the output of the oscillator, but to the output E of the generator 4.

When the switch S is open (normal working), the transistors T8 to T10 are saturated which blocks the transistors T3 and T4; the generator then behaves as two inverters in series and the signal issuing from the quartz oscillator present at the input F is found again at the output E.

When the switch S is closed (stocking position or time setting position), the transistors T8 and T10 are blocked and the generator delivers its short impulses, with its own frequency. The consumption of the input of the frequency divider due to this signal is then negligible.

As stated earlier, the resistance R1 would, in fact, represent the internal resistance of the transistor T7 in its conducting state.

Finally, in practice, the resistances R2 and R3 would be replaced by transistors connected in a manner to form current sources. These resistances would therefore not have to be integrated as such.

Figure 5:
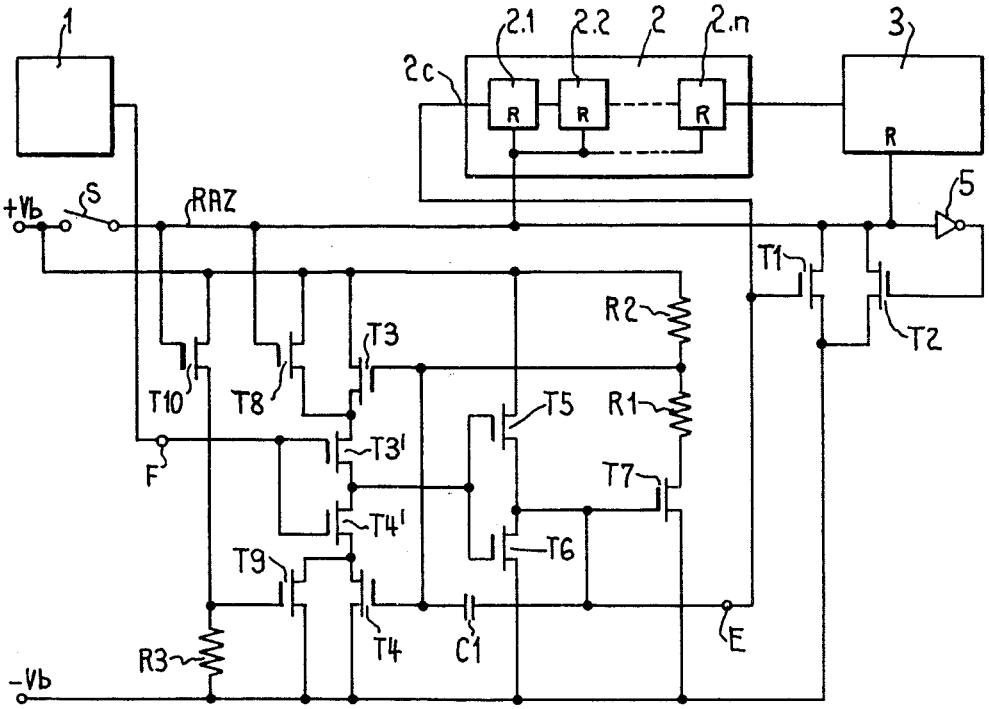
FIG. 5 shows the detailed diagram of one embodiment of the circuit in accordance with the invention.

A self-contained generator such as has been described in FIGS. 3 to 5 above is of particular interest for watches the oscillator of which delivers a signal at a relatively high frequency, of the order of 100 kHz or more. In such watches, the consumption of the first stages of the division chain is fairly high (this consumption grows proportionately to the frequency of the signals applied to the divider), and it is useful to be able to block these first stages when the watch is stopped, during its stocking in the manufacture or by the retailer, for example.

In watches the oscillator of which delivers a signal at a lower frequency, for example 32 kHz, as is the case for many watches in practice, the consumption of the first stages of the division chain is clearly less high. It is of the same order as that of the generator, and this latter is not as useful and can be discarded in favour of simpler solutions.

It is to be noted here that in an electronic watch, the consumption of the oscillator and of the division chain only represents part of the total consumption. It has already been noted that in general the oscillator is left to function continuously, even when the watch is stocked, for reasons of frequency stability. Moreover, leaving all or part of the division chain functioning in a watch the oscillator of which delivers signals at a relatively low frequency, whilst blocking the remainder of the circuits, especially the display and its control circuit, does not diminish in any notable fashion the length of the life of the power source.

The idea consists then in replacing the self-contained generator by a simpler circuit, whilst keeping into service the other elements which permit maintaining the common line at well determined voltages.

Figure 6:
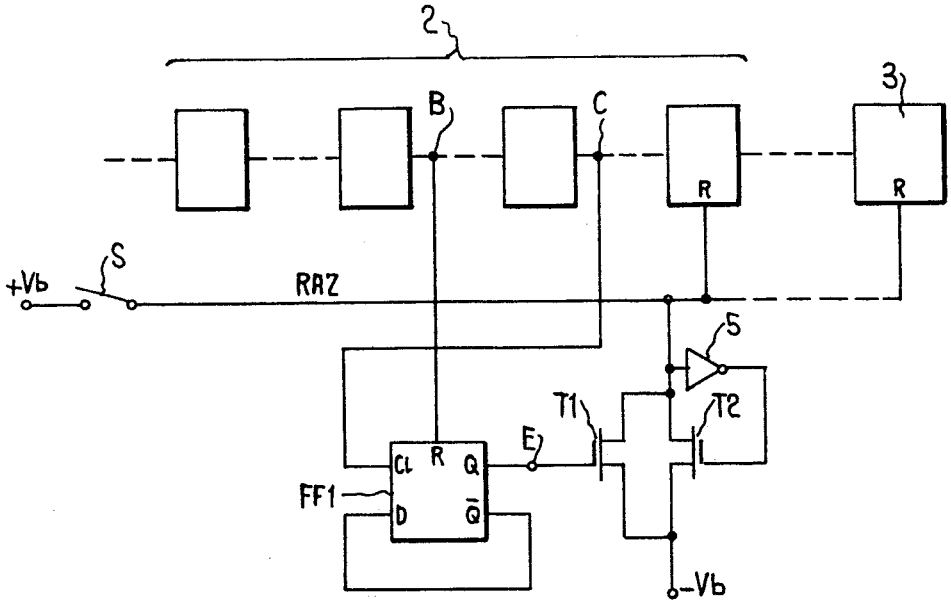
FIG. 6 shows a block diagram of another embodiment of the invention.

FIG. 6 shows a block diagram comprising already described members, such as the MOS transistors T1 and T2, inverter 5, and the frequency divider 2, as well as a replacement circuit for the self-contained generator 1 of FIG. 2. The common line RAZ is connected to the return to zero input R of some of the flip-flops forming the frequency divider 2, and the input R for blocking the display circuit 3.

The circuit replacing the generator of FIG. 2 is constituted by a D flip-flop FF1, with its return to zero input R connected to the output B of one of the flip-flops of the frequency divider 2, its input C1 connected to the output C of another flip-flop of the divider 2, situated further down the divider chain than B (that is to say that the frequency of the signal delivered at B is higher than that of the signal delivered at C), its input D connected to its own output $\overline{Q}$ and its output Q connected to the gate of the transistor T1.

The flip-flops which comprise the frequency divider 2 change state when the output of the flip-flop which precedes them in the chain changes from a "1" state to a "0" state, the point B being at the "0" state when the point C changes to "1". The flip-flop FF1 can thus change state, and its output Q changes to "1", which causes transistor T1 to conduct and thus applies the voltage $-V_b$ on the common line RAZ, when the switch S is open. A half period after a signal is delivered at B, the input R of flip-flop FF1 returns to the state "1", which makes this latter change state again so that its output Q returns to "Q". The circuit remains in this state until a "1" state appears at point C, whereupon the process is repeated.

Thus, it can be seen that the output Q of the flip-flop FF1 delivers impulses the cyclic ratio of which is given by the ratio between the half period of the signal delivered at the point B and the period of the signal delivered at the point C. By way of example, if the signals delivered at point B and point C have a frequency of 8'192 and 32 Hz respectively, the cyclic ratio of the signal delivered by the output Q of the flip-flop FF1 is equal to $2.10^{-3}$.

The same results would be obtained by replacing the flip-flop FF1 by a monostable circuit the input of which would be connected to the point C of the division chain, and which would deliver impulses at each passage of this point from the state "1" to the state "0" for example. These impulses should be very short, the value of the capacitance which determines this length would be very small, which would not pose any problem for its integration with the other elements of the circuit.

Figure 7:
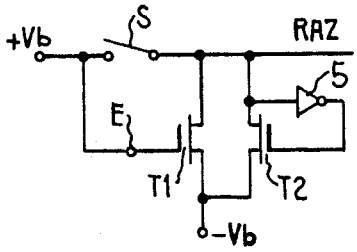
FIG. 7 shows the diagram of a simplified embodiment of the invention.

In another embodiment of the invention represented in FIG. 7, the transistor T1 is so constructed that its internal resistance, in the conducting state, is very high of the order of several megohms. This characteristic is easily obtained by providing this transistor with a long and narrow channel. The gate of this transistor can then be connected directly to the positive pole $+V_b$ of the supply source in a manner such that it will be constantly conducting.

When the switch S is closed, the voltage of the common line RAZ is virtually unaffected, and the current which passes in the transistor T1 is sufficiently low for it not to diminish the duration of the life of the power source. This current is on the other hand the same size as the current consumed by the generator of the version described earlier.

When the switch S is open the current through T1 is, however, sufficient for the voltage of the common line RAZ to fall to a value such that the output of the inverter 5 delivers a positive signal which renders the transistor T2 conducting. This latter has a low internal resistance, and the voltage $-V_b$ is then applied and reliably maintained on the line RAZ, as in the other embodiment of the circuit.

It is to be noted that the different embodiments described above are only by way of non-limitative example, and that modifications can be made thereto without either departing from the scope of the invention.

We claim:

1. In an electronic watch having a power supply means, a quartz oscillator, frequency divider means comprising flip-flops, and display means for displaying time information, at least some of the said flip-flops being connected to a common line and arranged in such a way that a signal applied to said common line places said flip-flops in a predetermined state, the improvement comprising a circuit for permitting stopping of said watch in a state of minimum consumption including a switch means, one of the terminals of which is connected to a first terminal of the supply and the other terminal to the common line, and first and second MOS transistors having their sources connected to the second supply terminal and their drains to the common line, the gate of the first of these transistors being connected to means for enabling it to be conducting at least periodically, and the gate of the second of these transistors being connected to the common line via an inverter.

2. A watch according to claim 1 in which the said for enabling comprises a self-contained generator which comprises at least one inverter circuit formed by third and fourth MOS transistors the sources of which are connected respectively to the first and second supply terminals and fifth and sixth MOS transistors and drains of which are connected together, and the sources are respectively connected to the drains of the said third and fourth transistors and the gates of said fifth and sixth transistors are connected together and to the output of the said oscillator.

3. A watch in accordance with claim 2, in which seventh and eighth MOS transistors have their sources and their drains connected respectively to the sources and to the drains of the said third and fourth transistors, and their gates connected, one directly, the other via an inverter, to the said common line, said frequency divider means having a counting input connected to the output of the generator.

4. A watch in accordance with claim 1, in which the said enabling means are constituted by a circuit provided with at least one input connected to the output of one of the flip-flops of said frequency divider, for producing impulses with a low cyclic ratio from the impulses delivered by the said flip-flop.

5. A watch in accordance with claim 1, in which the said means for enabling are constituted by a direct connection with the first supply terminal.

6. A watch according to claim 1 in which at least some of said display means are connected to said common line.

* * * * *

UNITED STATES PATENT OFFICE

CERTIFICATE OF CORRECTION

PATENT NO. : 4,130,988

DATED : December 26, 1978

INVENTOR(S) : Igor Scherrer et al

It is certified that error appears in the above-identified patent and that said Letters Patent are hereby corrected as shown below:

Claim 2, line 1 (col. 7, line 1), after "said" insert --means--.

Claim 2, line 6 (col. 7, line 6), after "transistors", change "and" to --the--.

Claim 4, line 2 (col. 8, line 5), change "said enabling means" to --means for enabling--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*